US006112550A

United States Patent [19]

Bonaquist et al.

[11] Patent Number: 6,112,550

[45] Date of Patent: Sep. 5, 2000

[54] CRYOGENIC RECTIFICATION SYSTEM AND HYBRID REFRIGERATION GENERATION

[75] Inventors: Dante Patrick Bonaquist; Bayram Arman, both of Grand Island; Joseph Alfred Weber, Cheektowaga; Walter Joseph Olszewski, Amherst; Mark Edward Vincett, Lancaster, all of N.Y.

[73] Assignee: Praxair Technology, Inc., Danbury, Conn.

[21] Appl. No.: 09/222,807

[22] Filed: Dec. 30, 1998

[51] Int. Cl.[7] ..... F25J 3/00

[52] U.S. Cl. ..... 62/646; 62/940

[58] Field of Search ..... 62/643, 646, 940

[56] References Cited

U.S. PATENT DOCUMENTS

| | | | |
|---|---|---|---|
| 4,303,428 | 12/1981 | Vandenbussche | 62/13 |
| 4,375,367 | 3/1983 | Prentice | 62/13 |
| 4,407,135 | 10/1983 | Pahade | 62/13 |
| 5,237,822 | 8/1993 | Rathbone | 62/25 |
| 5,287,704 | 2/1994 | Rathbone | 62/25 |
| 5,329,776 | 7/1994 | Grenier | 62/940 |
| 5,438,835 | 8/1995 | Rathbone | 62/646 |
| 5,475,980 | 12/1995 | Grenier | 62/646 |
| 5,511,381 | 4/1996 | Higginbotham | 62/646 |

OTHER PUBLICATIONS

Latimer, R.E., "The Distillation of Air", Chemical Engineering, vol. 63, No. 2, Feb. 1967, pp. 35–59.

*Primary Examiner*—Ronald Capossela
*Attorney, Agent, or Firm*—Stanley Ktorides

[57] ABSTRACT

A system for generating refrigeration and providing the refrigeration into a cryogenic rectification plant wherein, in addition to refrigeration generated by turboexpansion, further refrigeration for the plant is generated by a recirculating multicomponent refrigerant in a refrigeration circuit.

18 Claims, 3 Drawing Sheets

CRYOGENIC RECTIFICATION SYSTEM AND HYBRID REFRIGERATION GENERATION

TECHNICAL FIELD

This invention relates generally to cryogenic rectification and, more particularly, to the provision of refrigeration to a cryogenic rectification plant to carry out the cryogenic rectification.

BACKGROUND ART

Cryogenic rectification such as, for example, the cryogenic rectification of feed air to produce oxygen, nitrogen and argon, requires the provision of refrigeration for the cryogenic rectification plant. Typically such refrigeration is provided by the turboexpansion of a process stream. Turboexpansion is an energy intensive step and it is quite costly especially when larger amounts of refrigeration are required such as when one or more liquid products are required. In the case of cryogenic air separation, when argon product in addition to nitrogen and oxygen product is desired, turboexpansion of feed air can reduce argon recovery.

Accordingly it is an object of the invention to provide a system for providing refrigeration into a cryogenic rectification plant wherein not all of the requisite refrigeration for operating the plant is generated by turboexpansion of a process stream.

SUMMARY OF THE INVENTION

The above and other objects, which will become apparent to those skilled in the art upon a reading of this disclosure, are attained by the present invention, one aspect of which is:

A method for providing refrigeration for a cryogenic rectification plant comprising:

(A) compressing a multicomponent refrigerant fluid, expanding the compressed multicomponent refrigerant fluid to produce refrigeration and warming the expanded multicomponent refrigerant fluid by indirect heat exchange with a process fluid thereby passing refrigeration from the refrigerant fluid into the process fluid;

(B) passing refrigeration from the process fluid into the cryogenic rectification plant;

(C) turboexpanding a fluid stream to generate refrigeration and passing refrigeration from the turboexpanded fluid stream into the cryogenic rectification plant; and (D) using refrigeration generated by the expanded multicomponent refrigerant fluid and refrigeration generated by the turboexpanded fluid stream to produce at least one product by cryogenic rectification within the cryogenic rectification plant.

Another aspect of this invention is:

Apparatus for providing refrigeration into a cryogenic rectification plant comprising:

(A) a multicomponent refrigerant fluid refrigeration circuit comprising a compressor, expansion means and a heat exchanger, and means for passing multicomponent refrigerant fluid from the compressor to the expansion means, from the expansion means to the heat exchanger and from the heat exchanger to the compressor;

(B) means for passing process fluid through the heat exchanger and means for passing refrigeration from the process fluid into a cryogenic rectification plant;

(C) a turboexpander for generating refrigeration and means for passing refrigeration from the turboexpander into the cryogenic rectification plant; and (D) means for recovering product from the cryogenic rectification plant.

As used herein the term "refrigeration" means the capability to reject heat from a lower temperature to a higher temperature, typically from a subambient temperature to the surrounding ambient temperature.

As used herein the term "cryogenic rectification plant" means a facility for fractionally distilling a mixture by cryogenic rectification, comprising one or more columns and the piping, valving and heat exchange equipment attendant thereto.

As used herein, the term "feed air" means a mixture comprising primarily oxygen, nitrogen and argon, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, The Continuous Distillation Process.

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the more volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the terms "turboexpansion" and "turboexpander" mean respectively method and apparatus for the flow of high pressure fluid through a turbine to reduce the pressure and the temperature of the fluid thereby generating refrigeration.

As used herein the term "expansion" means to effect a reduction in pressure.

As used herein the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for the variable load refrigerant is at least 10° K., preferably at least 20° K. and most preferably at least 50° K.

As used herein the term "fluorocarbon" means one of the following: tetrafluoromethane ($CF_4$), perfluoroethane ($C_2F_6$), perfluoropropane ($C_3F_8$) perfluorobutane ($C_4F_{10}$), perfluoropentane ($C_5F_{12}$), perfluoroethene ($C_2F_4$), perfluoropropene ($C_3F_6$), perfluorobutene ($C_4F_8$), perfluoropentene ($C_5F_{10}$) hexafluorocyclopropane (cyclo-$C_3F_6$) and octafluorocyclobutane (cyclo-$C_4F_8$).

As used herein the term "hydrofluorocarbon" means one of the following: fluoroform ($CHF_3$), pentafluoroethane ($C_2HF_5$), tetrafluoroethane ($C_2H_2F_4$), heptafluoropropane ($C_3HF_7$), hexafluoropropane ($C_3H_2F_6$), pentafluoropropane ($C_3H_3F_5$), tetrafluoropropane ($C_3H_4F_4$), nonafluorobutane ($C_4HF_9$), octafluorobutane ($C_4H_2F_8$), undecafluoropentane ($C_5HF_{11}$), methyl fluoride ($CH_3F$), difluoromethane ($CH_2F_2$), ethyl fluoride ($C_2H_5F$), difluoroethane ($C_2H_4F_2$), trifluoroethane ($C_2H_3F_3$), difluoroethene ($C_2H_2F_2$), trifluoroethene ($C_2HF_3$), fluoroethene ($C_2H_3F$), pentafluoropropene ($C_3HF_5$), tetrafluoropropene ($C_3H_2F_4$), trifluoropropene ($C_3H_3F_3$), difluoropropene ($C_3H_4F_2$), heptafluorobutene ($C_4HF_7$), hexafluorobutene ($C_4H_2F_6$) and nonafluoropentene ($C_5HF_9$).

As used herein the term "fluoroether" means one of the following: trifluoromethyoxy-perfluoromethane ($CF_3$—O—$CF_3$), difluoromethoxy-perfluoromethane ($CHF_2$—O—$CF_3$), fluoromethoxy-perfluoromethane ($CH_2F$—O—$CF_3$), difluoromethoxy-difluoromethane ($CHF_2$—O—$CHF_2$), difluoromethoxy-perfluoroethane ($CHF_2$—O—$C_2F_5$), difluoromethoxy-1,2,2,2-tetrafluoroethane ($CHF_2$—O—$C_2HF_4$), difluoromethoxy-1,1,2,2-tetrafluoroethane ($CHF_{2-O-C2}HF_4$), perfluoroethoxy-fluoromethane ($C_2F_5$—O—$CH_2F$), perfluoromethoxy-1,1,2-trifluoroethane ($CF_3$—O—$C_2H_2F_3$), perfluoromethoxy-1,2,2-trifluoroethane ($CF_3O$—$C_2H_2F_3$), cyclo-1,1,2,2-tetrafluoropropylether (cyclo-$C_3H_2F_4$—O—), cyclo-1,1,3,3-tetrafluoropropylether (cyclo-$C_3H_2F_4$—O—), perfluoromethoxy-1,1,2,2-tetrafluoroethane ($CF_3$—O—$C_2HF_4$), cyclo-1,1,2,3,3-pentafluoropropylether (cyclo-$C_3H$—O—), perfluoromethoxy-perfluoroacetone ($CF_3$—O—$CF_2$—O—$CF_3$), perfluoromethoxy-perfluoroethane ($CF_3$—O—$C_2F_5$), perfluoromethoxy-1,2,2,2-tetrafluoroethane ($CF_3$—O—$C_2HF_4$), perfluoromethoxy-2,2,2-trifluoroethane ($CF_3$—O—$C_2H_2F_3$), cyclo-perfluoromethoxy-perfluoroacetone (cyclo-$CF_2$—O—$CF_2$—O—$CF_2$—) and cyclo-perfluoropropylether (cyclo-$C_3F_6$—O).

As used herein the term "atmospheric gas" means one of the following: nitrogen ($N_2$), argon (Ar), krypton (Kr), xenon (Xe), neon (Ne), carbon dioxide ($CO_2$), oxygen ($O_2$) and helium (He).

As used herein the term "non-toxic" means not posing an acute or chronic hazard when handled in accordance with acceptable exposure limits.

As used herein the term "non-flammable" means either having no flash point or a very high flash point of at least 600° K.

As used herein the term "low-ozone-depleting" means having an ozone depleting potential less than 0.15 as defined by the Montreal Protocol convention wherein dichlorofluoromethane ($CCl_2F_2$) has an ozone depleting potential of 1.0.

As used herein the term "non-ozone-depleting" means having no component which contains a chlorine, bromine or iodine atom.

As used herein the term "normal boiling point" means the boiling temperature at 1 standard atmosphere pressure, i.e. 14.696 pounds per square inch absolute.

Figure 1:
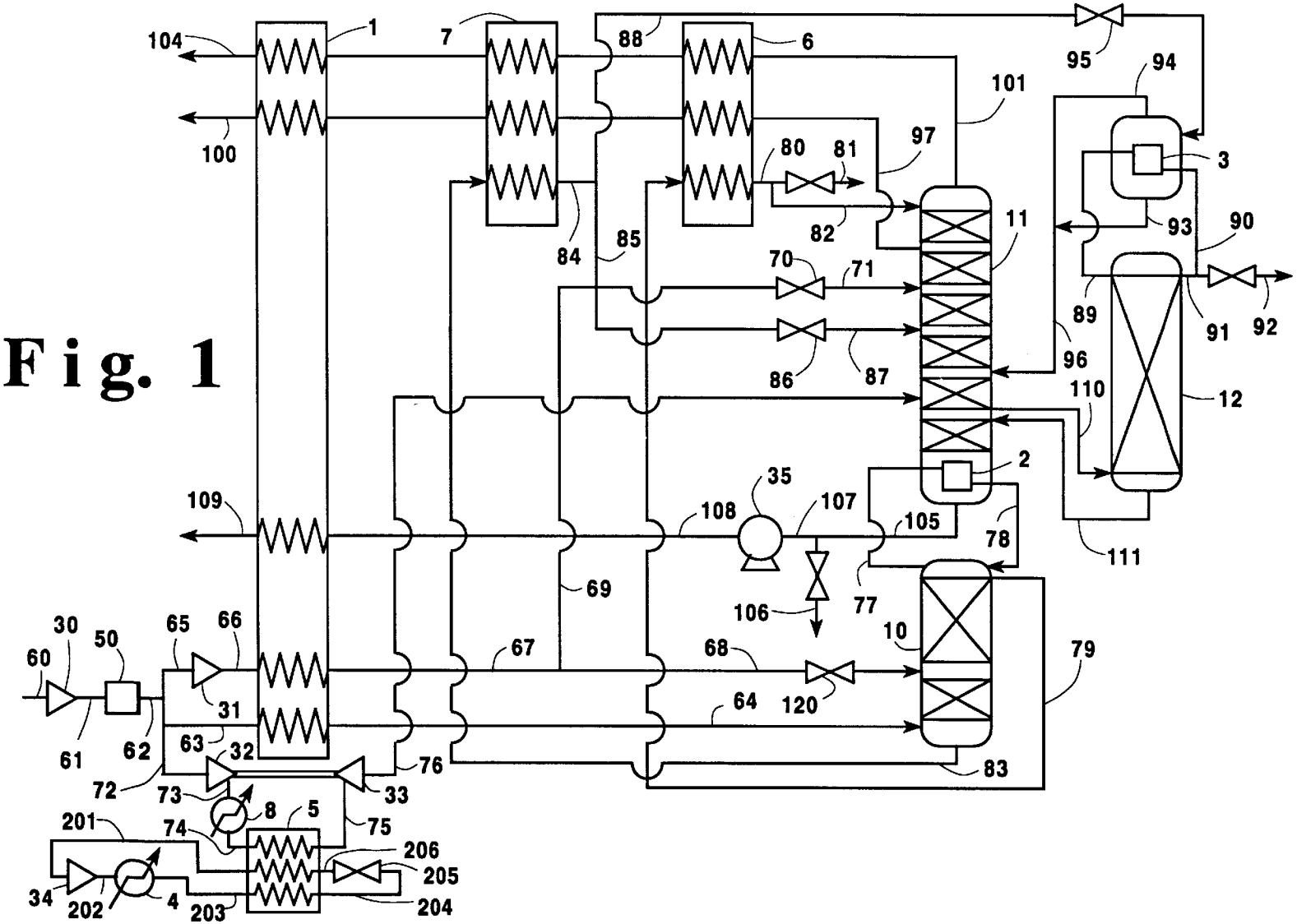
FIG. 1 is a schematic representation of one preferred embodiment of the invention wherein the multicomponent refrigerant fluid refrigeration circuit serves to cool the feed to the turboexpander.

The numerals in the Drawings are the same for the common elements.

DETAILED DESCRIPTION

The invention will be described in detail with reference to the Drawings. In FIG. 1 there is illustrated a cryogenic air separation plant having three columns including a double column having higher and lower pressure columns and an argon sidearm column.

Referring now to FIG. 1, feed air 60 is compressed by passage through base load compressor 30 to a pressure generally within the range of from 35 to 250 pounds per square inch absolute (psia). Resulting compressed feed air 61 is cooled of the heat of compression in an aftercooler (not shown) and is then cleaned of high boiling impurities such as water vapor, carbon dioxide and hydrocarbons by passage through purifier 50 and then purified feed air stream 62 is divided into three portions designated 65, 63 and 72. Portion 65, generally comprising from 20 to 35 percent of feed air stream 62, is further compressed by passage through booster compressor 31 to a pressure which may be up to 1000 psia, and resulting further compressed feed air stream 66 is cooled of the heat of compression in an aftercooler (not shown) and is cooled and preferably at least partially condensed by indirect heat exchange with return streams in main or primary heat exchanger 1. Resulting cooled feed air stream 67 is then divided into stream 68 which is passed through valve 120 and into higher pressure column 10 and into stream 69 which is passed through valve 70 and as stream 71 into lower pressure column 11.

Another portion 72, comprising from about 1 to 20 percent of feed air stream 62, is compressed to a pressure which may be up to 300 psia by passage through compressor 32, and resulting compressed stream 73 is cooled of the heat of compression by passage through aftercooler 8. Resulting feed air stream 74 is then passed through heat exchanger 5 of the multicomponent refrigerant fluid refrigeration circuit wherein it is cooled by transfer of refrigeration from the recirculating multicomponent refrigerant fluid as will be more fully described below. Resulting cooled feed air stream 75, which in this embodiment is the process fluid which receives refrigeration from the multicomponent refrigerant fluid, is turboexpanded by passage through turboexpander 33 to generate additional refrigeration, and resulting turboexpanded stream 76 is passed from turboexpander 33 into lower pressure column 11. In this way refrigeration generated by the multicomponent refrigerant fluid refrigeration circuit and refrigeration generated by the turboexpansion is passed into the cryogenic rectification plant with the passage of stream 76 into column 11.

The remaining portion 63 of feed air stream 62 is cooled by passage through main heat exchanger 1 by indirect heat exchange with return streams and passed as stream 64 into higher pressure column 10 which is operating at a pressure generally within the range of from 35 to 250 psia. Within higher pressure column 10 the feed air is separated by cryogenic rectification into nitrogen-enriched vapor and oxygen-enriched liquid. Nitrogen-enriched vapor is withdrawn from the upper portion of higher pressure column 10 in stream 77 and condensed in reboiler 2 by indirect heat exchange with boiling lower pressure column bottom liquid. Resulting nitrogen-enriched liquid 78 is returned to column 10 as reflux. A portion of the nitrogen-enriched liquid 79 is passed from column 10 to desuperheater 6 wherein it is subcooled to form subcooled stream 80. If desired, a portion 81 of stream 80 may be recovered as product liquid nitrogen having a nitrogen concentration of at least 99 mole percent. The remainder of stream 80 is passed in stream 82 into the upper portion of column 11 as reflux.

Oxygen-enriched liquid is withdrawn from the lower portion of higher pressure column 10 in stream 83 and passed to desuperheater 7 wherein it is subcooled. Resulting subcooled oxygen-enriched liquid 84 is then divided into portion 85 and portion 88. Portion 85 is passed through valve 86 and as stream 87 into lower pressure column 11. Portion 88 is passed through valve 95 and into argon column condenser 3 wherein it is partially vaporized. The resulting vapor is withdrawn from condenser 3 in stream 94 and passed as stream 96 into lower pressure column 11. Remaining oxygen-enriched liquid is withdrawn from condenser 3 in stream 93, combined with stream 94 to form stream 96 and then passed into lower pressure column 11.

Lower pressure column 11 is operating at a pressure less than that of higher pressure column 10 and generally within the range of from 15 to 100 psia. Within lower pressure column 11 the various feeds are separated by cryogenic rectification into nitrogen-rich vapor and oxygen-rich liquid. Nitrogen-rich vapor is withdrawn from the upper portion of column 11 in stream 101, warmed by passage through heat exchangers 6, 7 and 1, and recovered as product nitrogen in stream 104 having a nitrogen concentration of at least 99 mole percent. For product purity control purposes a waste stream 97 is withdrawn from column 11 from a level below the withdrawal point of stream 101, warmed by passage through heat exchangers 6, 7 and 1, and removed from the system in stream 100. Oxygen-rich liquid is withdrawn from the lower portion of column 11 in stream 105 having an oxygen concentration generally within the range of from 70 to 99.9 mole percent and preferably within the range of from 95 to 99.5 mole percent. If desired a portion 106 of stream 105 may be recovered as product liquid oxygen. The remaining portion 107 of stream 105 is pumped to a higher pressure by passage through liquid pump 35 and pressurized stream 108 is vaporized in main heat exchanger 1 and recovered as product elevated pressure oxygen gas 109.

Fluid comprising oxygen and argon is passed in stream 110 from lower pressure column 11 into argon column 12 wherein it is separated by cryogenic rectification into argon-richer fluid and oxygen-richer fluid. Oxygen-richer fluid is passed from the lower portion of column 12 in stream 111 into lower pressure column 11. Argon-richer fluid is passed from the upper portion of column 12 in vapor stream 89 into argon column condenser 3 wherein it is condensed by indirect heat exchange with the aforesaid partially vaporizing subcooled oxygen-enriched liquid. Resulting argon-richer liquid is withdrawn from condenser 3 in stream 90. A portion 91 is passed into argon column 12 as reflux and another portion 92 is recovered as product argon having an argon concentration generally within the range of from 95 to 99.999 mole percent.

Figure 2:
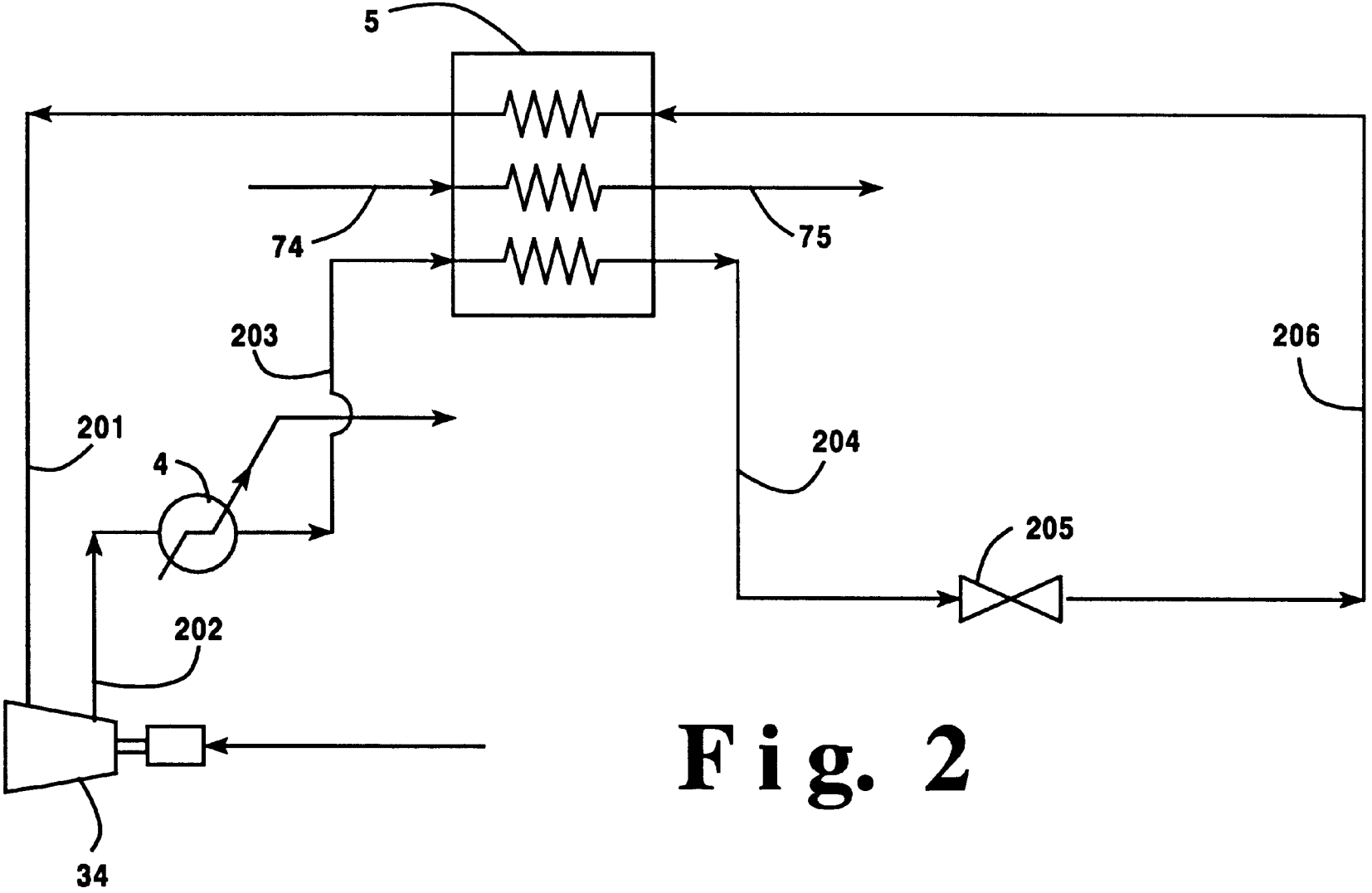
FIG. 2 is a more detailed representation of the multicomponent refrigerant fluid refrigeration circuit employed in the embodiment illustrated in FIG. 1.

Referring now to both FIGS. 1 and 2, there will be described in greater detail the operation of the multicomponent refrigerant fluid closed loop circuit which serves to generate a portion of the refrigeration passed into, i.e. provided for, the cryogenic rectification plant. Refrigeration is conventionally generated at a given temperature using a single component refrigerant fluid in a closed loop flow circuit. Examples of such conventional systems include home refrigerators and air conditioners. Multicomponent refrigerant fluids can provide variable amounts of refrigeration over a temperature range. Thus the refrigeration supply can be matched to the refrigeration requirements at each temperature thereby reducing system energy needs.

Multicomponent refrigerant fluid in stream 201 is compressed by passage through recycle compressor 34 to a pressure generally within the range of from 60 to 600 psia to produce compressed refrigerant fluid 202. The compressed refrigerant fluid is cooled of the heat of compression by passage through water cooled aftercooler 4 and may be partially condensed. The multicomponent refrigerant fluid in stream 203 is then further cooled by passage through refrigeration circuit heat exchanger 5 wherein it is further cooled and partially or completely condensed. Cooled, compressed multicomponent refrigerant fluid 204 is then expanded or throttled though valve 205 or optionally expanded through an expansion turbine. The throttling preferably partially vaporizes the multicomponent refrigerant fluid, cooling the fluid and generating refrigeration. Under some limited circumstances, dependent on heat exchanger conditions, the compressed fluid 204 may be subcooled liquid prior to expansion, and may remain as liquid following initial expansion. Subsequently, upon warming in the heat exchanger, the fluid would contain two phases.

Refrigeration bearing multicomponent two phase refrigerant fluid stream 206, having a temperature generally within the range of from 125 to 225° K., preferably 150 to 175° K. is then passed through heat exchanger 5 wherein it is warmed and completely vaporized thus serving by indirect heat exchange to cool stream 203 and also to transfer refrigeration into feed air stream 74 to produce cooled feed air stream 75. Stream 75 is ultimately passed into column 11 thus passing refrigeration generated by the multicomponent refrigerant fluid refrigeration circuit into the cryogenic rectification plant. The resulting warmed multicomponent refrigerant fluid in vapor stream 201 is then recycled to compressor 34 and the refrigeration cycle starts anew.

The pressure expansion of a fluid through a valve provides refrigeration by the Joule-Thomson effect, i.e. lowering of the fluid temperature due to pressure reduction at constant enthalpy. However, under some circumstances the fluid expansion could occur by utilizing a two-phase or liquid expansion turbine so that the fluid temperature would be additionally lowered due to work extraction by the turbine. Generally, for multicomponent refrigerants, the added cooling due to two-phase or liquid turbine expansion would be relatively low compared to the cooling associated with valve expansion. However, for gas expansion in a turbine, such as the feed air turboexpansion in turboexpander 33, the fluid cooling associated with the work extraction is considerably higher than would be available by a valve expansion of the gas stream. The key difference is that following pressure expansion of the multicomponent refrigerant fluid, there is available varying amounts of refrigeration as the fluid is rewarmed, whereas for the gas stream that is turboexpanded there is available a uniform amount of refrigeration as the gas is rewarmed. Thus the combination of the multicomponent refrigerant and the turboexpanded stream can provide process refrigeration as needed over a wide temperature range. The result is a close matching of required and supplied refrigeration over a wide temperature range within the process resulting in lower system energy requirements for the provision of the total required refrigeration.

The multicomponent refrigerant fluid contains two or more components in order to provide the required refrigeration at each temperature. The choice of refrigerant components will depend on the refrigeration load versus temperature for the particular process application. Suitable components will be chosen depending upon their normal boiling points, latent heat, and flammability, toxicity, and ozone-depletion potential.

One preferable embodiment of the multicomponent refrigerant fluid useful in the practice of this invention comprises at least two components from the group consisting of fluorocarbons, hydrofluorocarbons and fluoroethers.

Another preferable embodiment of the multicomponent refrigerant fluid useful in the practice of this invention comprises at least one component from the group consisting of fluorocarbons, hydrofluorocarbons and fluoroethers, and at least one atmospheric gas.

Another preferable embodiment of the multicomponent refrigerant fluid useful in the practice of this invention comprises at least two components from the group consisting of fluorocarbons, hydrofluorocarbons and fluoroethers, and at least two atmospheric gases.

Another preferable embodiment of the multicomponent refrigerant fluid useful in the practice of this invention comprises at least one fluoroether and at least one component from the group consisting of fluorocarbons, hydrofluorocarbons, fluoroethers and atmospheric gases.

In one preferred embodiment the multicomponent refrigerant fluid consists solely of fluorocarbons. In another preferred embodiment the multicomponent refrigerant fluid consists solely of fluorocarbons and hydrofluorocarbons. In another preferred embodiment the multicomponent refrigerant fluid consists solely of fluorocarbons and atmospheric gases. In another preferred embodiment the multicomponent refrigerant fluid consists solely of fluorocarbons, hydrofluorocarbons and fluoroethers. In another preferred embodiment the multicomponent refrigerant fluid consists solely of fluorocarbons, fluoroethers and atmospheric gases.

The multicomponent refrigerant fluid useful in the practice of this invention may contain other components such as hydrochlorofluorocarbons and/or hydrocarbons. Preferably, the multicomponent refrigerant fluid contains no hydrochlorofluorocarbons. In another preferred embodiment of the invention the multicomponent refrigerant fluid contains no hydrocarbons. Most preferably the multicomponent refrigerant fluid contains neither hydrochlorofluorocarbons nor hydrocarbons. Most preferably the multicomponent refrigerant fluid is non-toxic, non-flammable and non-ozone-depleting and most preferably every component of the multicomponent refrigerant fluid is either a fluorocarbon, hydrofluorocarbon, fluoroether or atmospheric gas.

The invention is particularly advantageous for use in efficiently reaching cryogenic temperatures from ambient temperatures. Tables 1–5 list preferred examples of multicomponent refrigerant fluid mixtures useful in the practice of this invention. The concentration ranges given in the Tables are in mole percent.

TABLE 1

| COMPONENT | CONCENTRATION RANGE |
|---|---|
| $C_5F_{12}$ | 5–25 |
| $C_4F_{10}$ | 0–15 |
| $C_3F_8$ | 10–40 |
| $C_2F_6$ | 0–30 |
| $CF_4$ | 10–50 |
| Ar | 0–40 |
| $N_2$ | 10–80 |

TABLE 2

| COMPONENT | CONCENTRATION RANGE |
|---|---|
| $C_3H_3F_5$ | 5–25 |
| $C_4F_{10}$ | 0–15 |
| $C_3F_8$ | 10–40 |
| $CHF_3$ | 0–30 |
| $CF_4$ | 10–50 |
| Ar | 0–40 |
| $N_2$ | 10–8 |

TABLE 3

| COMPONENT | CONCENTRATION RANGE |
|---|---|
| $C_3H_3F_5$ | 5–25 |
| $C_3H_3F_6$ | 0–15 |
| $C_2H_2F_4$ | 0–20 |
| $C_2HF_5$ | 5–20 |
| $C_2F_6$ | 0–30 |
| $CF_4$ | 10–50 |
| Ar | 0–40 |
| $N_2$ | 10–80 |

TABLE 4

| COMPONENT | CONCENTRATION RANGE |
|---|---|
| $CHF_2—O—C_2HF_4$ | 5–25 |
| $C_4H_{10}$ | 0–15 |
| $CF_3—O—CHF_2$ | 10–40 |
| $CF_3—O—CF_3$ | 0–20 |
| $C_2F_6$ | 0–30 |
| $CF_4$ | 10–50 |
| Ar | 0–40 |
| $N_2$ | 10–80 |

TABLE 5

| COMPONENT | CONCENTRATION RANGE |
|---|---|
| $C_3H_3F_5$ | 5–25 |
| $C_3H_2F_6$ | 0–15 |
| $CF_3$—O—$CHF_2$ | 10–40 |
| $CHF_3$ | 0–30 |
| $CF_4$ | 0–25 |
| Ar | 0–40 |
| $N_2$ | 10–80 |

Figure 3:
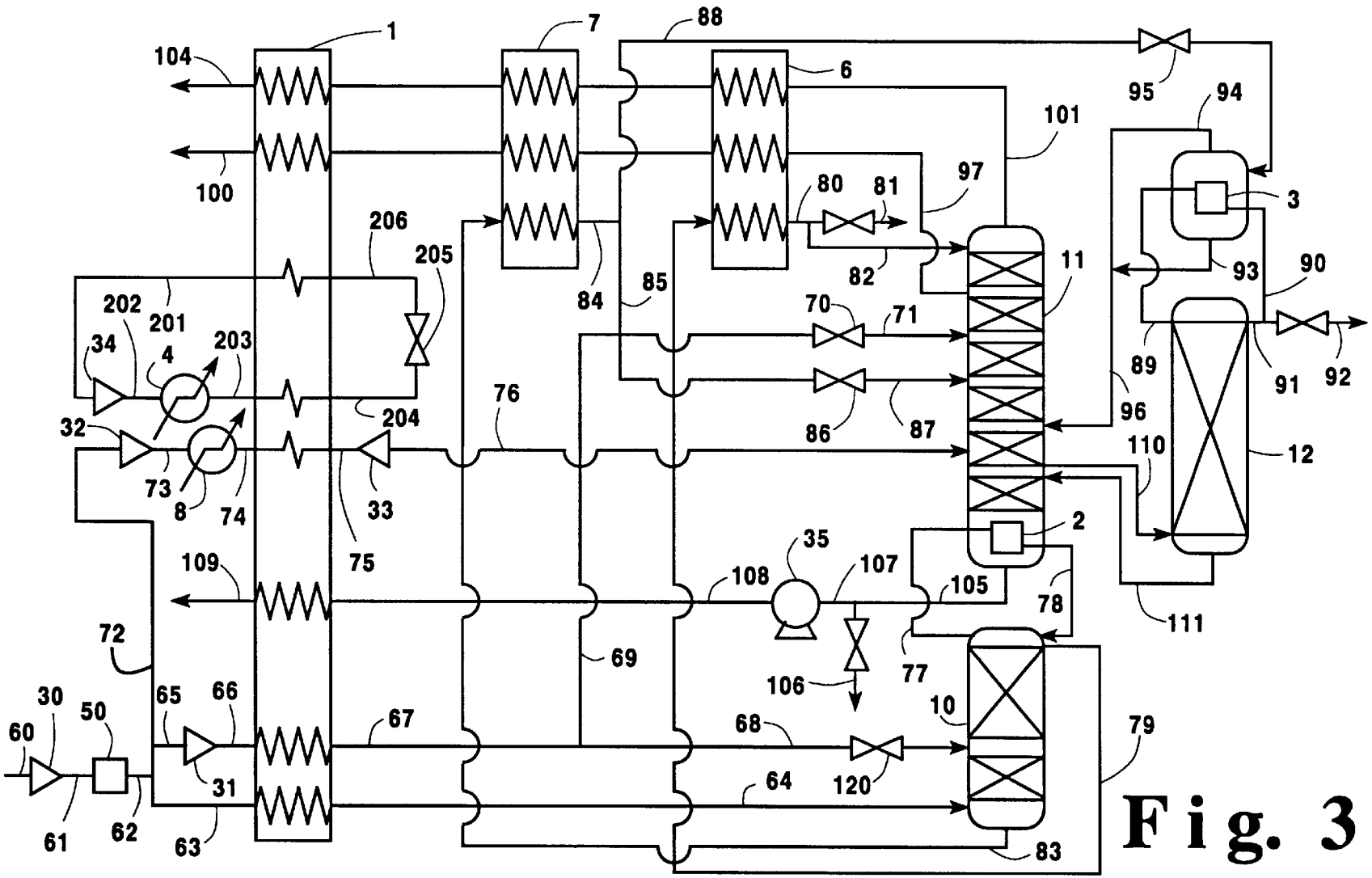
FIG. 3 is a schematic representation of another preferred embodiment of the invention wherein the heat exchanger of the multicomponent refrigerant fluid refrigeration circuit is the main heat exchanger of the cryogenic rectification plant.

FIG. 3 illustrates another preferred embodiment of the invention. The numerals in FIG. 3 are the same as that of those of FIG. 1 for the common elements which will not be described again in detail. The embodiment illustrated in FIG. 3 differs from that illustrated in FIG. 1 only in that there is no separate heat exchanger for the multicomponent refrigerant fluid refrigeration circuit. Rather, the main heat exchanger is used as the heat exchanger for the multicomponent refrigerant fluid refrigeration circuit. In the embodiment illustrated in FIG. 3 compressed feed air stream 74 is passed through main heat exchanger 1 rather than through a separate heat exchanger, and therein is cooled and picks up refrigeration by indirect heat exchange with refrigeration bearing multicomponent refrigerant fluid stream 206 which also passes through main heat exchanger 1 rather than through a separate heat exchanger.

It should be noted that the inclusion of the multicomponent refrigerant fluid refrigeration circuit and the turboexpansion can be at any temperature levels within the heat exchanger. For example, the multicomponent refrigerant can provide refrigeration at higher temperature levels whereas the turboexpansion can provide refrigeration at lower temperature levels. For some process applications dependent on the required refrigeration versus temperature pattern, it may be that turboexpansion is used to provide low temperature level refrigeration. It may even be that some process applications would require the two refrigerant methods to provide refrigeration for overlapping temperature ranges. Further, it should be noted that various process streams within the separation process can be turboexpanded to provide process refrigeration. Suitable process streams can include a feedstream, product or waste streams, or intermediate process streams. For cryogenic air separation, the suitable process streams could include feed air, product oxygen or nitrogen, waste nitrogen, or higher pressure column vapor.

Although the invention is illustrated utilizing a closed loop single flow circuit, some circumstances may require various flow variations for the refrigerant circuit. Dependent on process refrigeration requirements, it may be desirable to use multiple independent flow units, each with different refrigerant mixtures. Also it may be that a given flow circuit would utilize phase separations at one or more temperatures to allow internal recycle of refrigerant liquids and avoid undesirable cooling and possible freezing of those liquids. Finally, it may be desirable to include turboexpansion of the gaseous refrigerant fluid as another means of generating additional refrigeration. The specific choice of refrigerant flow circuit mixtures and process conditions, i.e. mixture compounds, compositions and pressure levels will depend on the specific process application and its associated refrigeration requirements.

The invention is especially useful for providing refrigeration over a wide temperature range, particularly one which encompasses cryogenic temperatures. In a preferred embodiment of the invention each of the two or more components of the refrigerant mixture has a normal boiling point which differs by at least 5 degrees Kelvin, more preferably by at least 10 degrees Kelvin, and most preferably by at least 20 degrees Kelvin, from the normal boiling point of every other component in that refrigerant mixture. This enhances the effectiveness of providing refrigeration over a wide temperature range, particularly one which encompasses cryogenic temperatures. In a particularly preferred embodiment of the invention, the normal boiling point of the highest boiling component of the multicomponent refrigerant fluid is at least 50° K., preferably at least 100° K., most preferably at least 200° K., greater than the normal boiling point of the lowest boiling component of the multicomponent refrigerant fluid.

The components and their concentrations which make up the multicomponent refrigerant fluid useful in the practice of this invention are such as to form a variable load multicomponent refrigerant fluid and preferably maintain such a variable load characteristic throughout the whole temperature range of the method of the invention. This markedly enhances the efficiency with which the refrigeration can be generated and utilized over such a wide temperature range. The defined preferred group of components has an added benefit in that they can be used to form fluid mixtures which are non-toxic, non-flammable and low or non-ozone-depleting. This provides additional advantages over conventional refrigerants which typically are toxic, flammable and/or ozone-depleting.

One preferred variable load multicomponent refrigerant fluid useful in the practice of this invention which is non-toxic, non-flammable and non-ozone-depleting comprises two or more components from the group consisting of $C_5F_{12}$, $CHF_2$—O—$C_2HF_4$, $C_4HF_9$, $C_3H_3F_5$, $C_2F_5$—O—$CH_2F$, $C_3H_2F_6$, $CHF_2$—O—$CHF_2$, $C_4F_{10}$, $CF_3$—O—$C_2H_2F_3$, $C_3HF_7$, $CH_2F$—O—$CF_3$, $C_2H_2F_4$, $CHF_2$—O—$CF_3$, $C_3F_8$, $C_2HF_5$, $CF_3$—O—$CF_3$, $C_2F_6$, $CHF_3$, $CF_4$, $O_2$, Ar, $N_2$, Ne and He.

Now with the practice of this invention one can effectively provide enhanced refrigeration into a cryogenic rectification plant. Although the invention has been described in detail with reference to certain particularly preferred embodiments, those skilled in the art will recognize that there are other embodiments of the invention within the spirit and the scope of the claims. For example, the process stream which receives refrigeration from the multicomponent refrigerant fluid refrigeration circuit need not be feed air, and moreover, need not be physically passed into a column of the cryogenic rectification plant. The invention may be practiced in conjunction with cryogenic air separation systems other than those illustrated in the drawings, and may be practiced in conjunction with other cryogenic rectification plants such as systems for natural gas upgrading, hydrogen recovery from raw syngas, and carbon dioxide production.

We claim:

1. A method for providing refrigeration for a cryogenic rectification plant comprising:

(A) compressing a multicomponent refrigerant fluid, expanding the compressed multicomponent refrigerant fluid to produce refrigeration and warming the expanded multicomponent refrigerant fluid by indirect heat exchange with a process fluid thereby passing refrigeration from the refrigerant fluid into the process fluid;

(B) passing refrigeration from the process fluid into the cryogenic rectification plant;

(C) turboexpanding a fluid stream to generate refrigeration and passing refrigeration from the turboexpanded fluid stream into the cryogenic rectification plant; and (D) using refrigeration generated by the expanded multicomponent refrigerant fluid and refrigeration generated by the turboexpanded fluid stream to produce at least one product by cryogenic rectification within the cryogenic rectification plant.

2. The method of claim 1 wherein the refrigeration from the process fluid is passed into the cryogenic rectification plant by passing the process fluid into a column of the cryogenic rectification plant.

3. The method of claim 1 wherein the refrigeration from the turboexpanded fluid stream is passed into the cryogenic rectification plant by passing the turboexpanded fluid stream into a column of the cryogenic rectification plant.

4. The method of claim 1 wherein the process fluid is a feed air stream and wherein said feed air stream is turboexpanded to become the turboexpanded fluid stream and is subsequently passed into a column of the cryogenic rectification plant.

5. The method of claim 1 wherein the multicomponent refrigerant fluid comprises at least two components from the group consisting of fluorocarbons, hydrofluorocarbons and fluoroethers.

6. The method of claim 1 wherein the multicomponent refrigerant fluid comprises at least one component from the group consisting of fluorocarbons, hydrofluorocarbons and fluoroethers and at least one atmospheric gas.

7. The method of claim 1 wherein the multicomponent refrigerant fluid comprises at least two components from the group consisting of fluorocarbons, hydrofluorocarbons and fluoroethers and at least two atmospheric gases.

8. The method of claim 1 wherein the multicomponent refrigerant fluid comprises at least one fluoroether and at least one component from the group consisting of fluorocarbons, hydrofluorocarbons, fluoroethers and atmospheric gases.

9. The method of claim 1 wherein each of the components of the multicomponent refrigerant fluid has a normal boiling point which differs by at least 5 degrees Kelvin from the normal boiling point of each of the other components of the multicomponent refrigerant fluid.

10. The method of claim 1 wherein the normal boiling point of the highest boiling component of the multicomponent refrigerant fluid is at least 50° K. greater than the normal boiling point of the lowest boiling component of the multicomponent refrigerant fluid.

11. The method of claim 1 wherein the multicomponent refrigerant fluid comprises at least two components from the group consisting of $C_5F_{12}$, $CHF_2—O—C_2HF_4$, $C_4HF_9$, $C_3H_3F_5$, $C_2F_5—O—CH_2F$, $C_3H_2F_6$, $CHF_2—O—CHF_2$, $C_4F_{10}$, $CF_3—O—C_2H_2F_3$, $C_3HF_7$, $CH_2F—O—CF_3$, $C_2H_2F_4$, $CHF_2—O—CF_3$, $C_3F_8$, $C_2HF_5$, $CF_3—O—CF_3$, $C_2F_6$, $CHF_3$, $CF_4$, $O_2$, Ar, $N_2$, Ne and He.

12. The method of claim 1 wherein the multicomponent refrigerant fluid is a variable load multicomponent refrigerant fluid throughout the whole temperature range of the method.

13. Apparatus for providing refrigeration into a cryogenic rectification plant comprising:

(A) a multicomponent refrigerant fluid refrigeration circuit comprising a compressor, expansion means and a heat exchanger, and means for passing multicomponent refrigerant fluid from the compressor to the expansion means, from the expansion means to the heat exchanger and from the heat exchanger to the compressor;

(B) means for passing process fluid through the heat exchanger and means for passing refrigeration from the process fluid into a cryogenic rectification plant;

(C) a turboexpander for generating refrigeration and means for passing refrigeration from the turboexpander into the cryogenic rectification plant; and (D) means for recovering product from the cryogenic rectification plant.

14. The apparatus of claim 13 wherein the means for passing refrigeration from the process fluid into the cryogenic rectification plant comprises means for passing process fluid from the heat exchanger into a column of the cryogenic rectification plant.

15. The apparatus of claim 13 wherein the means for passing refrigeration from the turboexpander into the cryogenic rectification plant comprises means for passing fluid from the turboexpander into a column of the cryogenic rectification plant.

16. The apparatus of claim 15 further comprising means for passing process fluid from the heat exchanger to the turboexpander.

17. The apparatus of claim 13 comprising a main heat exchanger through which feed for the cryogenic rectification plant is passed, wherein the heat exchanger of the multicomponent refrigerant fluid refrigeration circuit is said main heat exchanger.

18. The apparatus of claim 13 wherein said multicomponent refrigerant fluid refrigeration circuit is a closed loop circuit.

* * * * *

UNITED STATES PATENT AND TRADEMARK OFFICE

CERTIFICATE OF CORRECTION

PATENT NO. : 6,112,550

DATED : September 5, 2000

INVENTOR(S) : Bonaquist, et al.

It is certified that error appears in the above-indentified patent and that said Letters Patent is hereby corrected as shown below:

ON THE TITLE PAGE

In the title delete "AND" and insert therefor --WITH--.

In column 8, Table 2, for the concentration range of $N_2$, delete "10-8" and insert therefor --10-80--.

Signed and Sealed this

Eighth Day of May, 2001

*Attest:*

Nicholas P. Godici

NICHOLAS P. GODICI

*Attesting Officer*

*Acting Director of the United States Patent and Trademark Office*